US008166854B2

(12) United States Patent
Fujimura

(10) Patent No.: US 8,166,854 B2
(45) Date of Patent: May 1, 2012

(54) SHEARING DEVICE

(75) Inventor: Shiro Fujimura, Kariya (JP)

(73) Assignee: Toyota Boshoku Kabushiki Kaisha, Aichi (JP)

( * ) Notice: Subject to any disclaimer, the term of this patent is extended or adjusted under 35 U.S.C. 154(b) by 698 days.

(21) Appl. No.: 11/547,314

(22) PCT Filed: Mar. 17, 2005

(86) PCT No.: PCT/JP2005/004805

§ 371 (c)(1),
(2), (4) Date: Oct. 3, 2006

(87) PCT Pub. No.: WO2005/097373

PCT Pub. Date: Oct. 20, 2005

(65) Prior Publication Data

US 2007/0144230 A1 Jun. 28, 2007

(30) Foreign Application Priority Data

Apr. 9, 2004 (JP) ..... 2004-115550

(51) Int. Cl.
*B26D 1/00* (2006.01)
*B26D 3/00* (2006.01)

(52) U.S. Cl. ..... 83/13; 83/51; 83/684; 83/694

(58) Field of Classification Search ..... 83/694, 83/51, 862, 865, 685, 684, 623, 454, 13; 72/329, 330, 327, 326; 29/329, 330, 327, 29/326

See application file for complete search history.

(56) References Cited

U.S. PATENT DOCUMENTS

| | | | | |
|---|---|---|---|---|
| 2,213,919 | A * | 9/1940 | Michon | 83/684 |
| 3,211,034 | A * | 10/1965 | Andris | 83/137 |
| 3,554,065 | A * | 1/1971 | Kunz | 83/124 |
| 3,583,266 | A * | 6/1971 | Kondo | 83/51 |
| 3,739,669 | A * | 6/1973 | Seki | 83/123 |
| 3,878,746 | A * | 4/1975 | Carmeli | 83/126 |
| 4,586,360 | A * | 5/1986 | Jurgensmeyer et al. | 72/328 |

(Continued)

FOREIGN PATENT DOCUMENTS

JP 49-10483 1/1974

(Continued)

OTHER PUBLICATIONS

Fine Blanking prior art, Industrial Press Inc., Manufacturing Process Reference Guide, First Edition, 1994, Library of Congress Cataloging in Publication Data, 6 pages.

*Primary Examiner* — Boyer D Ashley
*Assistant Examiner* — Omar Flores Sanchez
(74) *Attorney, Agent, or Firm* — Patterson Thuente Christensen Pedersen, P.A.

(57) ABSTRACT

In a shearing device (10), a plate-like work piece (50) is seated on a die (20) positioned on a lower side thereof is clamped by a pad (30), so that a predetermined portion of the work piece (50) is processed into a predetermined shape by a punch positioned on an upper side thereof. The punch (40) integrally has a heel portion (41). The heel portion is so as to broadly contact an outer peripheral face (51) of the predetermined portion to be processed of the work piece (50), thereby restraining the outer peripheral face (51) from moving in an outward direction perpendicular to a thickness direction.

13 Claims, 5 Drawing Sheets

U.S. PATENT DOCUMENTS

| | | | | | |
|---|---|---|---|---|---|
| 4,611,483 | A | * | 9/1986 | Hadaway | 72/453.02 |
| 4,628,780 | A | * | 12/1986 | Hicks | 83/99 |
| 5,247,862 | A | * | 9/1993 | Haack | 83/27 |
| 5,458,717 | A | * | 10/1995 | Kurita | 156/253 |
| 5,702,556 | A | * | 12/1997 | Okuma et al. | 156/261 |
| 5,996,458 | A | * | 12/1999 | Maeda | 83/456 |
| 6,063,228 | A | * | 5/2000 | Sasaki et al. | 156/261 |
| 6,370,931 | B2 | * | 4/2002 | Bennett | 72/336 |
| 6,729,172 | B2 | * | 5/2004 | Aizaki | 72/329 |
| 6,757,975 | B1 | * | 7/2004 | Todd et al. | 29/893.33 |
| 7,107,808 | B2 | * | 9/2006 | Miyahara | 72/329 |
| 7,117,706 | B2 | * | 10/2006 | Savoy | 72/334 |
| 7,162,906 | B2 | * | 1/2007 | Van Dalen et al. | 72/331 |
| 2003/0066329 | A1 | | 4/2003 | Aizaki | |

FOREIGN PATENT DOCUMENTS

| | | | |
|---|---|---|---|
| JP | 58-004231 | | 1/1983 |
| JP | 60-249598 | | 12/1985 |
| JP | 2-80167 | | 3/1990 |
| JP | 02-160125 | | 6/1990 |
| JP | 5-200448 | | 8/1993 |
| JP | 6-23619 | | 3/1994 |
| JP | 7-214189 | | 8/1995 |
| JP | 11-156456 | | 6/1999 |
| JP | 2002-321022 | | 11/2002 |
| JP | 2003-503208 | | 1/2003 |
| JP | 2003-080322 | | 3/2003 |
| JP | 2003-117619 | | 4/2003 |
| JP | 2003-170229 | | 6/2003 |
| WO | WO 01/00396 | A2 | 1/2001 |

* cited by examiner

SHEARING DEVICE

TECHNICAL FIELD

The present invention relates to a shearing device. More specifically, the present invention relates to a shearing device that can impart a shearing force to a work piece by means of a pressing machine or other such machines, so as to finish cut surfaces of the work piece with a high accuracy.

BACKGROUND ART

Generally, a fine blanking method is generally well known as a method that can press mold a metal material with a high accuracy, so as to form a product having various shapes such as a car part or other such parts. According to the fine blanking method (which will be hereinafter referred to as "FB method"), a shearing force can be applied to a metal material with a high degree of accuracy even if the metal material has a relatively large thickness. Therefore, the product can be finished so as to have smooth cut surfaces (with a desired accuracy) without producing cracks and fracture surfaces therein. Thus, the FB method may produce a finished product having smooth cut surfaces.

More specifically, the FB method utilizes a hydraulic pressing machine in which various components can be hydraulically operated so as to permit complicated motion thereof. In particular, a work piece (the metal material) is clamped between a pad (a hold-down plate) and a die so as to be held therebetween. Therefore, when a punch cooperates with the die such that a shearing force can be applied to the work piece (when the clearance between the punch and the die is minimized), a relief force that acts in the work piece (i.e., an outward force that acts in a direction perpendicular to the shearing force) can be suppressed. Alternatively, an elongated projection (a V-ring) is formed between the pad and the die in order to increase the holding power of the pad and the die. In this case, the work piece can be held between the pad and the die while the retainer member bites into the work piece. Therefore, the relief force can be further reduced. As a result, the shearing force can be convergently applied to the work piece. This may lead to a high-accuracy processing of the work piece.

In addition, when a shearing force is applied to the work by means of the punch and the die, a bending force acts on the work piece due to the clearance between the punch and the die, so that an acting force (a spring-up force) can be applied to the work piece, which acts to urge the work piece to spring up from the punch. Therefore, in order to prevent the work piece from springing-up from the punch and to suppress the shearing force from dispersing, an ejector (a product retainer) is provided on the opposite side of the punch (so as to oppose the punch with interleaving the work piece therebetween), thereby suppressing the action of this spring-up force. In particular, the various components can be hydraulically operated in a complicated manner so as to provide a pressing condition in which the ejector can suppress the spring-up of the work piece while moderately applying the shearing force of the punch to the work piece.

A related technique is disclosed in, for example, JP 02-160125 A.

DISCLOSURE OF THE INVENTION

Problems to be Solved by the Invention

In the above-mentioned conventional technique, it is possible to finish the work piece into the product having precise cut surfaces. However, it is necessary to hydraulically operate the various components (the ejector, etc.) in the complicated manner. As a result, the number of machine components must be increased. Also, the machine must be increased in size and thus more complicated. In addition, such a method requires increased working steps for press molding, for example, a condition setting operation such as a size adjustment, and maintenance or other such processes. This may lead to an increased production cost. Further, it is rather difficult to achieve an accuracy improvement of processing of the work piece and a stabilized quality of the product. As a result, the method is unsuitable for mass-production.

Further, in the FB method, the cut-formed product and scraps remain on the die and the ejector even after completion of the processing. Therefore, in order to transfer the product to a next processing step, it is necessary to discharge the scraps that are positioned coplanar with the product when the processing is completed. Thus, an additional step and a corresponding extra time are required for pushing off the cut scraps. As a result, it rather difficult to achieve a faster processing time.

Moreover, as described above, the elongated projection (the V-ring) is formed between the pad and the die in order to suppress the relief force that acts on the work piece during processing. However, such a structure cannot sufficiently suppress the relief force. As a result, it is necessary to further provide additional members, for example, a member that can guide the work piece at both sides.

The present invention has been made in order to solve the above-mentioned problems. It is, accordingly, one object of the present invention to finish cut surfaces of a shear formed work piece with a high accuracy, to simplify a construction of a pressing machine, and to achieve a faster processing time.

Means for Solving the Problems

In order to solve the problems, a shearing device of the present invention is constructed as follows.

A first invention is a shearing device for processing a predetermined portion of a plate-shaped work piece into a predetermined shape by a punch while the work piece is clamped between a die and a pad. The shearing device is provided with the punch integrally having a constraining portion. The constraining portion is positioned so as to contact an outer peripheral face of the predetermined portion to be processed of the work piece while the work piece is clamped between the die and the pad, thereby restraining the outer peripheral face from moving in an outward direction perpendicular to a thickness direction. The outer peripheral face of the work piece is restricted from moving during shearing.

When a shearing force is applied to the plate-like work piece in the thickness direction by the punch and the die, the outer peripheral face of the predetermined portion to be processed may be applied with a force (a relief force) in the outward direction perpendicular to the thickness direction. Further, a shearing force applied portion of the work piece is applied with a spring-up force which urges the work piece to spring up from the punch.

According to the first invention, the punch for applying the shearing force to the work piece is integrally provided with the constraining portion that contacts the outer peripheral face of the predetermined portion to be processed of the work piece. Therefore, the outer peripheral face of the work piece is restricted from moving in the outward direction perpendicular to the thickness direction during processing. Further, a constraining force acting on the outer peripheral face from the constraining portion also acts as a reactive force (a slide friction resistance) against the spring-up force which urges the work piece to spring up from the punch. Thus, because the predetermined portion to be processed of the work piece is restricted from moving during processing, the predetermined portion to be processed can be applied with the shearing force with a high degree of accuracy.

Further, there is no need to provide an ejector for restraining the work piece 50 from springing-up. Therefore, for example, when the work piece is cut, cut off portions can be pushed off downwardly.

Next, a second invention is the shearing device defined in claim 1, in which the work piece is positioned below the die, and the pad is positioned further below the work piece.

According to the second invention, the cut off portions of the work piece do not remain on a member such as the pad. That is, the cut off portions of the work piece can be directly pushed off downwardly.

Next, a third invention is the shearing device defined in claim 1 or 2, in which the constraining portion is formed with a tapered portion that is thinned toward a forward end.

According to the third invention, the outer peripheral face of the predetermined portion to be processed of the work piece may become a contacting condition while it is guided by the tapered portion of the constraining portion that moves together with the punch. Therefore, even if a clearance formed between the outer peripheral face of the predetermined portion of the work piece to be processed and the constraining portion is set to be minimized or closed, the outer peripheral face and the constraining portion may smoothly come in contact each other.

Next, a fourth invention is the shearing device defined in any of claims 1 to 3, in which the shearing device has a pre-treating means for treating the outer peripheral face of the predetermined portion of the workpiece to be processed with a desired accuracy at a stage prior to processing the predetermined portion of the work piece into the predetermined shape by the punch.

According to the fourth invention, at the stage prior to processing a predetermined portion of the work piece into the predetermined configuration by the punch, the outer peripheral face of the predetermined portion of the work piece to be processed is treated with a desired accuracy by the pre-processing means. Therefore, the outer peripheral face to contact the constraining portion during processing is previously treated with the desired accuracy.

Next, a fifth invention is the shearing device defined in any of claims 1 to 4, in which the constraining portion has a divided form so as to correspond to a stepped configuration of the work piece.

According to the fifth invention, the constraining portion has a divided form so as to correspond to a stepped configuration of the work piece. Therefore, even if the work piece having a complicated configuration (a stepped configuration) is processed, a required constraining force or reactive force is applied to the work piece by the constraining portion.

Effects of the Invention

The present invention includes the above-mentioned means, so as to provide the following effects.

First, according to the first invention, it is possible to perform shearing with a high accuracy by simply moving the punch having the constraining portion with respect to the work piece clamped between the pad and the die. Therefore, it is not necessary to provide an ejector for restraining the work piece from moving in a spring-up direction during processing. In addition, it is not necessary to provide a hydraulic control mechanism for operating various components in a complicated manner during processing. As a result, it is possible to use a commonly used link pressing machine, thereby simplifying a construction of the device. This may lead to a reduced manufacturing cost and consistent quality.

Further, in spite of such a simplified construction, the shearing force can be convergently applied to the work piece. Therefore, it is possible to obtain smooth cut surfaces with a high accuracy. In addition, during cutting, the cut scraps can be automatically pushed off downwardly by moving the punch. Therefore, it is possible to remarkably reduce additional steps and a corresponding time that are required for discharging the scraps. As a result, it is possible to achieve a speeding up of the processing while the cut surfaces of the product can be finished with a high accuracy.

Further, according to the second invention, the scraps can be reliably pushed off downwardly.

Further, according to the third invention, even if the outer peripheral face of the predetermined portion to be processed of the work piece is set so as to closely contact the constraining portion, the outer peripheral face and the constraining portion can easily become the contacting condition by simply moving the punch downwardly. Therefore, it is possible to further increase a processing accuracy of the work piece.

Further, according to the fourth invention, it is possible to improve the condition of contact between the constraining portion and the outer peripheral face during processing. Therefore, it is possible to further increase a processing accuracy of the work piece.

Further, according to the fifth invention, even if the work piece has a complicated configuration, it is possible to apply a required constraining force or reactive force during processing. Therefore, it is possible to perform processing with a high accuracy.

BEST MODE FOR CARRYING OUT THE INVENTION

An embodiment of a best mode for carrying out the present invention will be described hereinafter with reference to the drawings.

Figure 1:
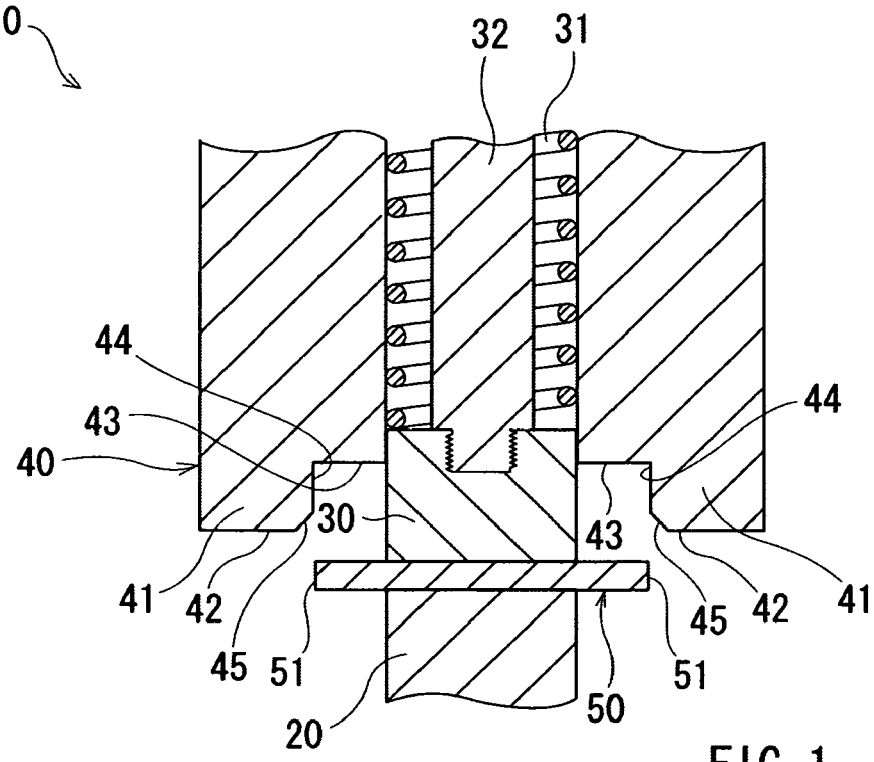
FIG. 1 An enlarged cross-sectional view of a main portion of a shearing device of the present embodiment, which illustrates a condition before processing.
Figure 2:
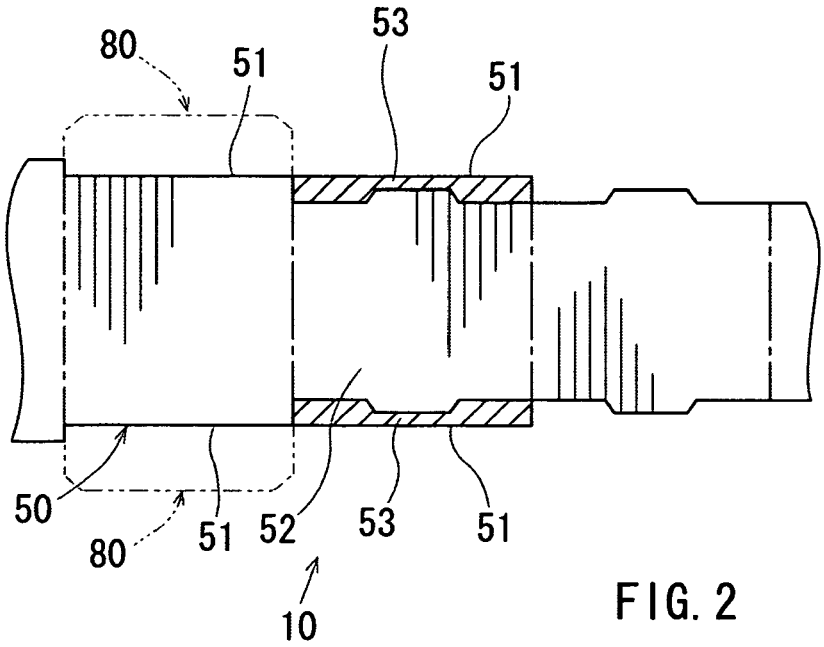
FIG. 2 A view showing a flow of processing steps for shearing a work piece.
Figure 3:
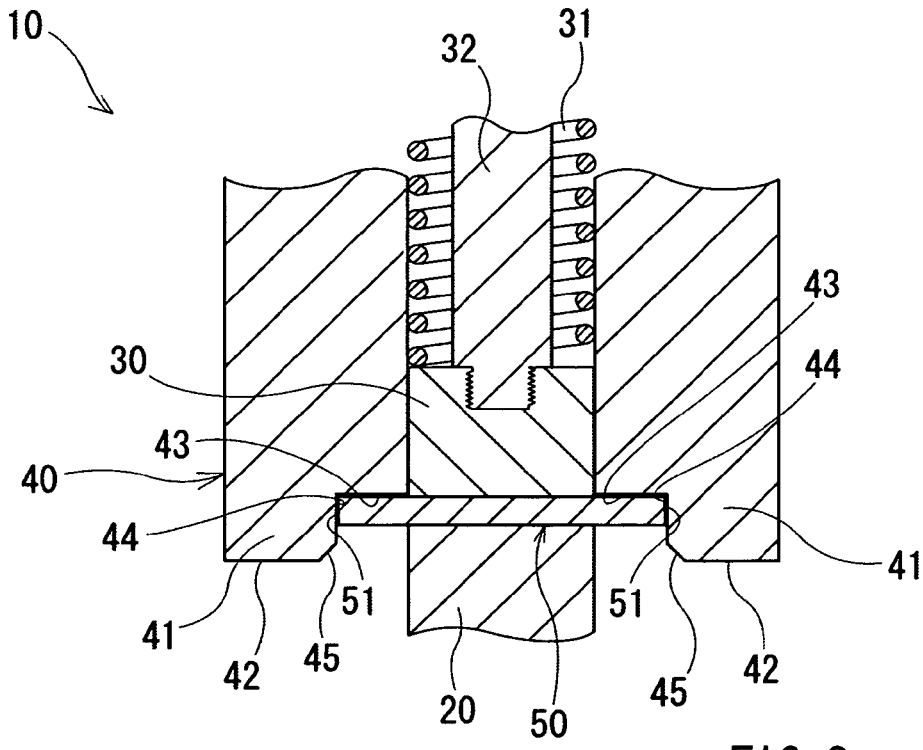
FIG. 3 A view showing a condition in which a constraining portion of FIG. 1 broadly contacts the work piece.
Figure 4:
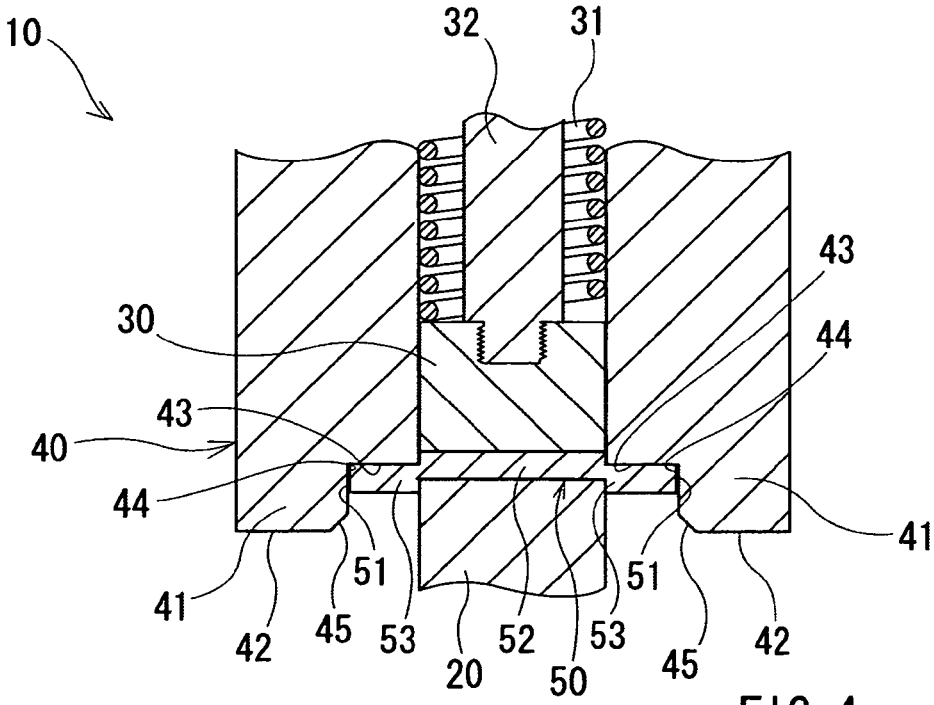
FIG. 4 A view showing a condition in which the work piece is applied with a shearing force.
Figure 5:
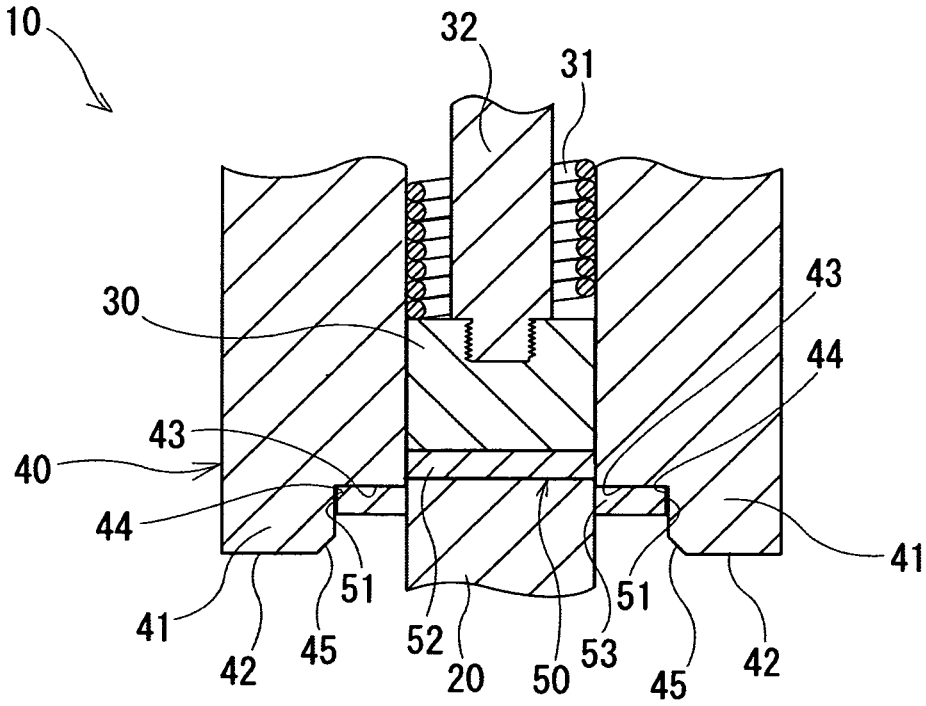
FIG. 5 A view showing a condition in which the work piece is cut.
Figure 6:
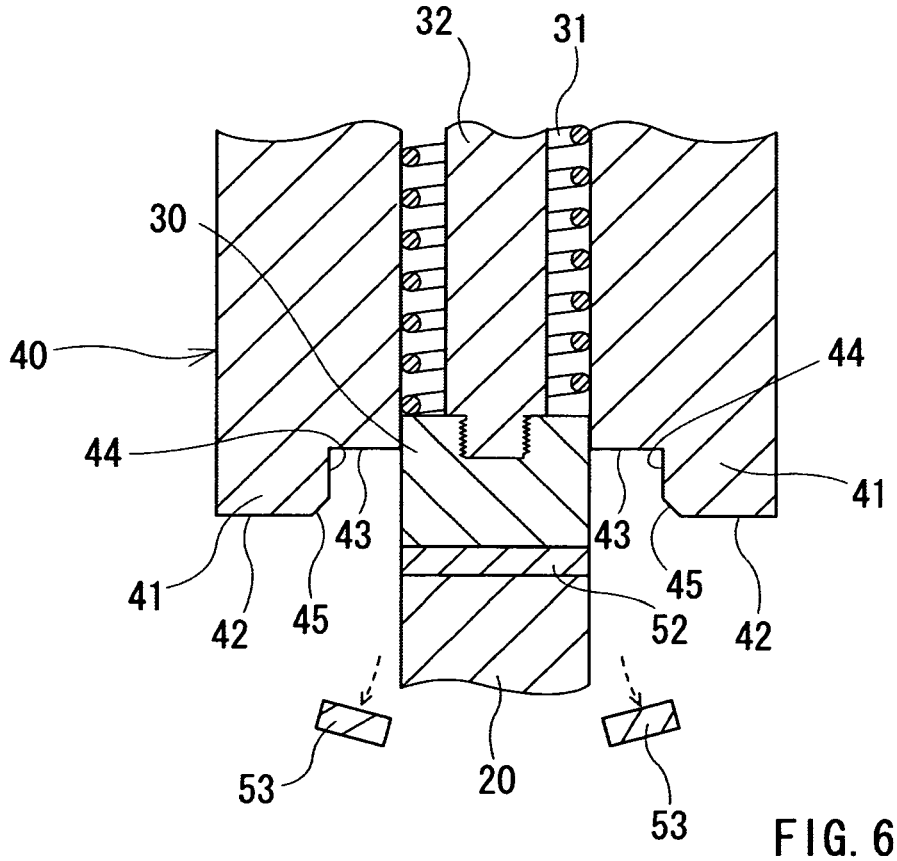
FIG. 6 A view showing a condition in which cut scraps are pushed off.

FIGS. 1 to 6 show a shearing device 10 according to an embodiment of the present invention. FIG. 1 is an enlarged cross-sectional view of a main portion of the shearing device 10 of the present embodiment, which illustrates a condition before processing. FIG. 2 is a view showing a flow of processing steps for shearing a work piece 50. FIG. 3 is a view showing a condition in which a constraining portion 41 of FIG. 1 broadly contacts the work piece 50. FIG. 4 is a view showing a condition in which the work piece 50 is sheared. FIG. 5 is a view showing a condition in which the work piece 50 is cut. FIG. 6 is a view showing a condition in which cut scraps 53 are pushed off.

First, as best shown in FIGS. 1 and 2, the work piece 50 to be formed in the present embodiment is an elongated steel plate (a coil material) having a constant thickness. The work piece 50, when processed, is continuously fed into the shearing device 10 via a conveying device such as an uncoiler, a leveler and a roll feeder (each of which is not shown) and is successively sent in the longitudinal direction at a continuous constant pitch, so as to be subjected to processing in a stepwise fashion.

As best shown in FIG. 2, in the processing in the present embodiment, at a stage prior to forming the work piece 50 into a predetermined shape, lateral end surfaces of the work piece 50 are trimmed (roughly treated) by a pre-treating device 80. Thus, outer peripheral surfaces 51 are treated with a desired accuracy, so as to have a predetermined width. As a result, when the work piece 50 is sheared, the outer peripheral surfaces 51 thereof may provide a reliable broad contacting condition with respect to the constraining portions 41 of the shearing device 10 which is described hereinafter, thereby allowing an accuracy improvement of subsequent shearing. Further, the pre-treating device 80 corresponds to a pre-treating means of the present invention. In the drawing, the reference numeral 53 indicates scraps, and the reference numeral 52 indicates a product.

Next, the shearing device 10 is constructed (as a mechanical crank press) so as to reciprocate a punch 40 via a crank utilizing a rotational force of a drive motor. In particular, as best shown in FIG. 1, the shearing device 10 is mainly composed of a die 20, a pad 30 and a punch 40. The die 20 may receive the plate-shaped work piece 50 thereon and function as a lower cutter blade during processing. The pad 30 may cooperate with the die 20 so as to clamp the work piece 50 therebetween along a thickness direction during processing. The punch 40 is positioned above the work piece 50 and may function as an upper cutter blade.

For more detail, the die 20 is secured to a lower die base of the shearing device 10, so as to support an inner side of the work piece 50 from below during processing.

Next, as best shown in FIG. 1, the pad 30 is connected to a backing plate (not shown) via a shoulder bolt 32. The backing plate may vertically reciprocate due to a driving force of a drive motor. In particular, the shoulder bolt 32 is extended downwardly from above the backing plate and is projected downwardly therethrough, so as to be slidable (vertically) relative to each other. A head portion (not shown) of the bolt is projected upwardly from the backing plate, and an opposite end thereof (a forward end of the shoulder bolt 32) is connected to the pad 30. Also, a coil spring 31 is disposed between the backing plate and the pad 30 so as to surround the shoulder bolt 32.

Thus, the pad 30 may move downwardly together with the backing plate, so as to contact the work piece 50 seated on the die 20, thereby providing a clamping force on the die 20. In particular, as best shown in FIG. 3, when the backing plate moves downwardly so that the pad 30 contacts the work piece 50, the coil spring 31 is contracted due to a biasing force caused by the downward movement of the backing plate. As a result, the pad 30 may be subjected to a restoring force (an elastic force) of the contracted coil spring 31, thereby providing the clamping force to the work piece 50.

Next, as best shown in FIG. 1, the punch 40 is integrally formed with the constraining portions 41 having a heel shape in cross section at its lower end. In particular, the constraining portions 41 are partially projected vertically and downwardly from pressing surfaces 43 of the punch 40, so as to define contact surfaces 44. The contact surfaces 44 can broadly contact the outer peripheral surfaces 51 of the work piece 50 that is cut so as to have the predetermined width. The contact surfaces 44 are configured so as to provide the reliable broad contacting condition to the outer peripheral surfaces 51 of the work piece 50 that is seated on the die 20 during processing (a condition in which a clearance formed therebetween is minimized). Further, both of the punch 40 and the constraining portions 41 are formed from a metal material having a superior toughness (HAP5R manufactured by Hitachi Metals, Ltd.).

Further, the constraining portions 41 have tapered portions 45 at lower ends 42 thereof. The tapered portions 45 are formed along sides of the contact surfaces 44 (i.e., sides that broadly contact the outer peripheral surfaces 51 of the work piece 50 to be processed) so as to be thinned toward forward ends (the lower ends 42). The tapered portions 45 may guide the outer peripheral surfaces 51 of the work piece 50 when the punch 40 moves downwardly, so that the outer peripheral surfaces 51 can be smoothly introduced into the contact surfaces 44 of the constraining portions 41.

Next, an upper end of the punch 40 is connected to the above-mentioned backing plate, so as to reciprocate integrally with the backing plate.

Thus, before the processing is performed, the punch 40 moves downwardly together with the pad 30 depending on the downward movement of the backing plate. Then, as best shown in FIG. 3, when the pad 30 contacts the work piece 50, the pad 30 imparts the clamping force to the work piece 50 due to the contraction of the coil spring 31. After that, as best shown in FIG. 4, only the punch 40 further moves downwardly by means of the backing plate, so that the pressing surfaces 43 of the punch 40 can apply a pressing force to portions of the work piece 50, which portions are to be cut off as the scraps 53.

When the pressing force is applied to the work piece 50 by the pressing surfaces 43 of the punch 40, a shearing force is applied to the work piece 50 due to a positional relationship between the punch 40 and the die 20 (due to a clearance therebetween). As a result, a relief force may act on the outer peripheral surfaces 51 of the work piece 50 in an outward direction perpendicular to a thickness direction. However, at this time, the outer peripheral surfaces 51 of the work piece 50 provide the broad contacting condition with respect to the contact surfaces 44 of the constraining portions 41. Therefore, the outer peripheral surfaces 51 is applied with a reactive force (a force against the relief force) from the contact surfaces 44 of the constraining portions 41. As a result, the outer peripheral surfaces 51 of the work piece 50 are restricted from moving in this direction (i.e., the outward direction perpendicular to the thickness direction).

Further, the work piece 50 is applied with a spring-up force in addition to the relief force mentioned above when it is applied with the shearing force. The spring-up force is a force that urges the work piece 50 to spring up from the pressing surfaces 43 of the punch 40. In particular, the spring-up force results from a bending force that is produced due to the clearance between (the pressing surfaces 43 of) the punch 40 and the die 20 when the shearing force is applied. The bending force acts on the work piece 50 (the portions to be cut off as the scraps 53) so as to urge the work piece 50 to spring up from the pressing surfaces 43. However, the spring-up force is suppressed by the reactive force (the force against the relief force) from the contact surfaces 44 of the constraining portions 41. That is, due to this reactive force, a slide friction force is produced between the contact surfaces 44 of the constraining portions 41 and the outer peripheral surfaces 51 of the work piece 50, and this force acts as a reactive force against the spring-up force. Therefore, the outer peripheral surfaces 51 of the work piece 50 (the portions to be cut off as the scraps 53) is restrained from moving in a spring-up direction.

Thus, according to the shearing device 10 of the present embodiment, during processing (when the shearing force is applied), the work piece 50 is prevented from moving due to the relief force and the spring-up force. As a result, during processing, the shearing force applied to the work piece 50 may convergently (highly accurately) act on predetermined positions without being dispersed.

Subsequently, a method of operating the present embodiment will be described with reference to FIGS. 1 to 6.

First, as best shown in FIG. 1, the work piece 50 (see FIG. 2) is seated on the die 20. The lateral end surfaces of the work piece 50 are trimmed (roughly treated) with a desired accuracy at the pre-treating step, so as to have a predetermined width. Thereafter, the drive motor of the shearing device 10 is driven, so that the punch 40 moves downward. When the pad 30 reaches a position of the work piece 50, the coil spring 31 is contracted as a result of the downward movement of the backing plate, so that the clamping force is applied to the work piece 50. Thereafter, when the lower ends 42 of the constraining portions 41 reach the outer peripheral surfaces 51 of the work piece 50 as a result of the downward movement of the punch 40, the outer peripheral surfaces 51 of the work piece 50 are introduced into the contact surfaces 44 while the outer peripheral surfaces 51 are guided by the tapered portions 45 of the constraining portions 41, thereby providing the broad contacting condition therebetween. Further, as best shown in FIG. 3, when the punch 40 further moves downward, the pressing surfaces 43 of the punch 40 may contact the work piece 50.

Next, as best shown in FIG. 4, when the punch 40 further moves downward after the pressing surfaces 43 contact the work piece 50, the shearing force is applied to the work piece 50 due to the pressing force caused by this movement. At this time, the relief force and the spring-up force may act on the work piece 50. However, because the reactive force is generated by the contact surfaces 44 of the constraining portions 41, the work piece 50 is restrained from moving toward directions corresponding to the relief force and the spring-up force. Therefore, as best shown in FIGS. 2 and 5, the shearing force may convergently (highly accurately) act on the predetermined positions of the work piece 50. As a result, the work piece 50 is cut into the product 52 and the scraps 53. The product 52 may have a predetermined shape corresponding to the shape of the punch 40.

Also, as best shown in FIG. 6, the cut scraps 53 are automatically pushed off downwardly. Therefore, when the punch 40 moves upwardly, only the product 52 is seated on the die 20. Thus, it is possible to transfer the product 52 to a next processing step without conducting a discharging operation of the scraps 53.

Thus, in the shearing device 10 of the present embodiment, by simply moving the punch 40 having the constraining portions 41 downwardly against the work piece 50 clamped between the pad 30 and the die 20, the shearing force can be convergently (highly accurately) applied to the work piece 50. Therefore, it is possible to obtain smooth cut surfaces without fracture. That is, the shearing device 10 is not necessary to include an ejector for restraining the work piece 50 from moving in the spring-up direction during processing. In addition, it is possible to eliminate a hydraulic control mechanism for operating various components in a complicated manner during processing. Therefore, it is possible to use a commonly used link pressing machine instead of a conventional hydraulic pressing machine. Thus, it is possible to simplify a construction of the device, thereby reducing a failure of the device. This may lead to a reduced manufacturing cost and a stabilized quality.

In addition, because the ejector is not required, the scraps 53 cut by the shearing can be automatically pushed off downwardly. Therefore, it is possible to remarkably reduce additional steps and a corresponding time that are required for discharging the scraps 53. That is, it is possible to achieve a speeding up of the processing while the cut surfaces of the product 52 can be finished with a high accuracy.

Further, because the tapered portions 45 are formed in the contact surfaces 44 of the constraining portions 41, it is possible to smoothly introduce the outer peripheral surfaces 51 of the work piece 50 into the contact surfaces 44 while the outer peripheral surfaces 51 are guided by the tapered portions 45. Therefore, it is possible to establish the reliable broad contacting condition with respect to the outer peripheral surfaces 51 of the work piece 50. Thus, it is possible to further increase the effect of the reactive force. Further, because both of the punch 40 and the constraining portions 41 are formed from the metal material having a superior toughness, there is little risk that these members can be partly destroyed by virtue of a load such as the relief force or other such forces. As a result, the reactive force can be produced in a stable manner.

Although one representative embodiment of the present invention has been described hereinbefore, the present invention can be carried out in various modified forms in addition to the above-mentioned embodiment.

Figure 7:
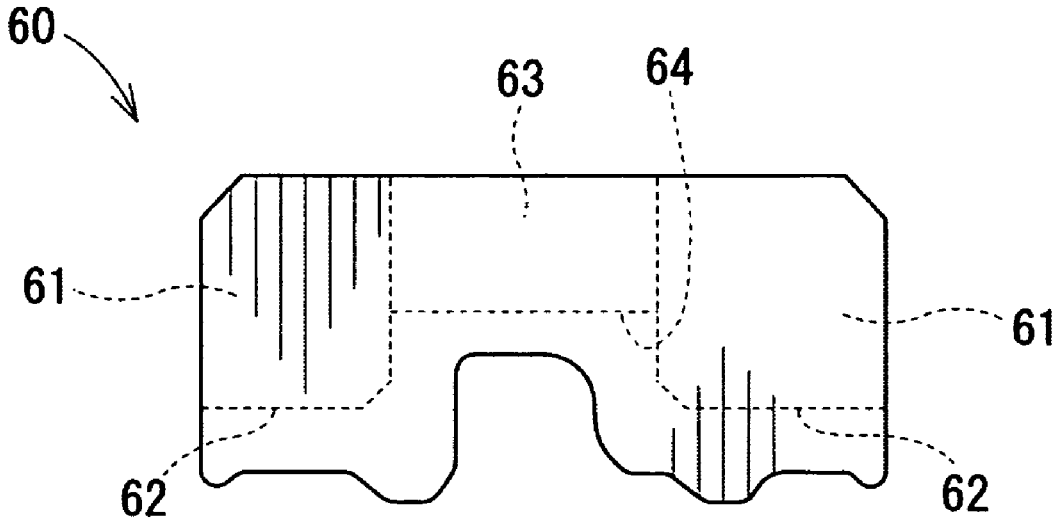
FIG. 7 A plan view of a punch that is used for a product having a shape different from a product in the present embodiment.
Figure 8:
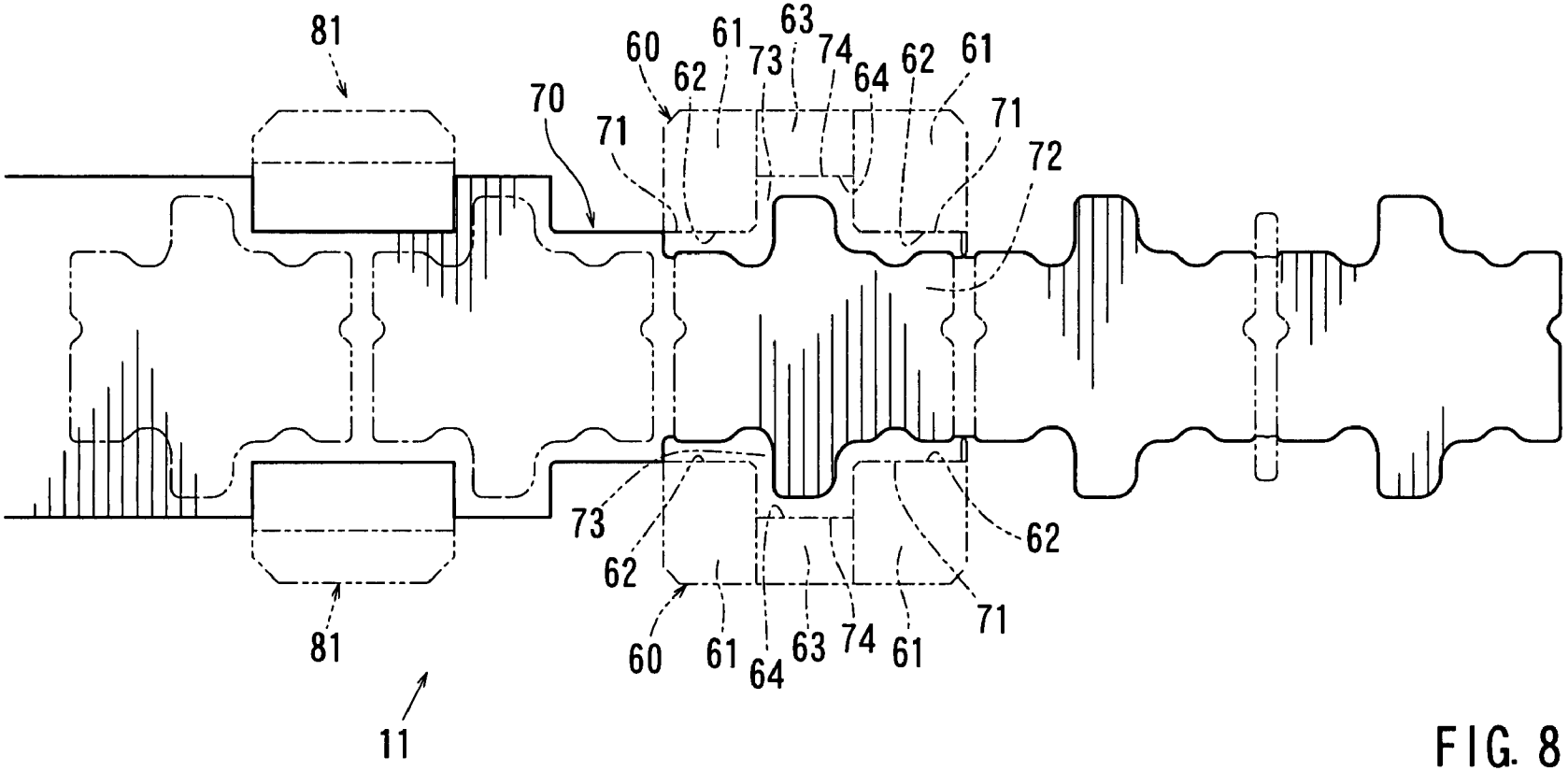
FIG. 8 A view showing a flow of processing steps for shearing a work piece by utilizing the punch of FIG. 7.

According to the shearing device 10 of the present embodiment, it is possible to finish the product 52 with a high degree of accuracy. Therefore, the shearing device is particularly useful to produce a product of which the cut surfaces are used as sliding surfaces, e.g., a product that is used as a component of a reclining mechanism of a vehicle seat. In order to form such a product, a punch 60 (a shearing device 11) having a configuration, for example, as shown in FIGS. 7 and 8. The punch 60 is formed with constraining portions 61 that are positioned spaced apart from each other at both ends thereof. Also, the punch 60 is formed with a constraining portion 63 positioned at the center thereof. The connecting portion is recessed below the constraining portions 61. That is, the constraining portions 61 and 63 have a divided form. This is because a work piece 70 is cut so as to have a projection at a central portion thereof (so as to have a stepped configuration). Further, the constraining portions 61 and 63 are provided with contact surfaces 62 and 64 that can respectively broadly contact side outer peripheral surfaces 71 and central outer edge surfaces 74 of the work piece 70. The constraining portions 61 and 63 are formed with tapered portions at the lower ends thereof. Therefore, as best shown in FIG. 8, during processing, the outer peripheral surfaces 71 and 74 of the work piece 70 respectively provide a broad contacting condition with respect to the contact surfaces 62 and 64. That is, even if the work piece 70 has such a complicated configuration, it is possible to perform processing while the punch 60 and the constraining portions 61, 63 are close to each other. Therefore, when the work piece 70 is processed, it is possible to constantly apply the reactive forces against the relief force and the spring-up force. As a result, it is possible to finish a product 72 having a predetermined shape (produced by pushing off scraps 73) with a high degree of accuracy. Further, in this case, the outer peripheral surfaces 71 and 74 of the work piece 70 are trimmed with a desired accuracy by utilizing a pre-treating device 81 corresponding to the pre-processing means of the present invention, so as to perform a high precision shearing.

Although a commonly used link pressing machine is used as the shearing device 10 in the present embodiment, a hydraulic pressing machine can be used. Further, although in the present embodiment, the work piece 50 is sheared by applying the shearing force thereto, it is also possible to apply a shearing force in bending or drawing, thereby performing a high precision shearing.

The invention claimed is:

1. A method for processing a predetermined portion of a plate-shaped work piece into a predetermined shape, the work piece having a top surface, a bottom surface, and an outer peripheral face, the predetermined portion corresponding to scraps to be removed, the method comprising:

arranging a die and a pad to clamp the work piece therebetween;

arranging a punch relative to the die and pad, the punch integrally having a constraining portion, the constraining portion having a contact surface that is continuous with a pressing surface of the punch;

applying a shearing force to the work piece via the pressing surface of the punch, wherein the bottom surface of the work piece corresponding to the pressing surface of the punch is unsupported during shearing, said unsupported bottom surface defining the scraps when the shearing force is applied, wherein arranging the punch includes positioning the contact surface of the constraining portion so as to contact the outer peripheral face of the predetermined portion of the work piece while the work piece is clamped between the die and the pad, thereby providing a reactive force restraining the outer peripheral face from moving in an outward direction perpendicular to a thickness direction when the shearing force is applied; and allowing the scraps to automatically fall away as the shearing force is applied.

2. The method of claim 1, wherein the contact of the contact surface of the constraining portion with the outer peripheral face of the work piece provides a slide friction force on the work piece such that the work piece is restricted from moving in the thickness direction away from the pressing surface when the shearing force is applied.

3. The method of claim 1, wherein the step of arranging the die and pad to clamp the work piece includes positioning the work piece below the pad and the die below the work piece.

4. The method of claim 1, further comprising arranging a coil spring to subject the pad to a restoring force when the coil spring is contracted that provides a clamping force for clamping the work piece between the pad and the die.

5. A shearing device for processing a predetermined portion of a plate-shaped work piece into a predetermined shape in combination with the workpiece, the workpiece having a top surface, a bottom surface, and an outer peripheral face, the predetermined portion corresponding to scraps to be removed, the shearing device comprising:

a die and a pad that are arranged and constructed to clamp the work piece therebetween; and a punch integrally having a constraining portion, the constraining portion having a contact surface that is continuous with a pressing surface of the punch, wherein the punch, die and pad are arranged and constructed to apply a shearing force to the work piece via the pressing surface of the punch, wherein the bottom surface of the work piece corresponding to the pressing surface of the punch is unsupported during shearing, said unsupported bottom surface defining the scraps during shearing, wherein the contact surface is positioned so as to contact the outer peripheral face of the predetermined portion of the work piece while the work piece is clamped between the die and the pad, thereby providing a reactive force restraining the outer peripheral face from moving in an outward direction perpendicular to a thickness direction during shearing, wherein the contact of the contact surface of the constraining portion with the outer peripheral face of the work piece provides a slide friction force on the work piece such that the work piece is restricted from moving in the thickness direction away from the pressing surface during shearing, and wherein after shearing, the scraps automatically fall away.

6. The shearing device defined in claim 5, wherein the work piece is positioned below the pad, and wherein the die is positioned further below the work piece.

7. The shearing device defined in claim 5, wherein the constraining portion is formed with a tapered portion that is thinned toward a forward end.

8. The shearing device defined in claim 5, wherein the constraining portion has a divided form so as to correspond to a stepped configuration of the work piece.

9. The shearing device defined in claim 5, further comprising a coil spring, the coil spring subjecting the pad to a restoring force when the coil spring is contracted that provides a clamping force for clamping the work piece between the pad and the die.

10. The shearing device defined in claim 5, wherein the punch is arranged and constructed such that the portion of the work piece that is unsupported defines a pair of scrap pieces, each scrap piece located on an opposing outer side of the work piece.

11. A shearing device for processing a predetermined portion of a plate-shaped work piece into a predetermined shape, in combination with the workpiece, the workpiece having a upper surface, a lower surface, and an outer peripheral face, the shearing device comprising:

a die and a pad that are arranged and constructed to clamp the work piece therebetween; and a punch integrally having a constraining portion, the constraining portion having a contact surface that is continuous with a pressing surface of the punch, wherein the contact surface is positioned so as to contact all of the outer peripheral face of the work piece while the work piece is clamped between the die and the pad, thereby restraining the outer peripheral face from moving in an outward direction perpendicular to a thickness direction during shearing, wherein the outer peripheral face of the work piece is restricted from moving during shearing, and wherein the punch is arranged and constructed to apply a shearing force to the work piece via the pressing surface of the punch while a bottom surface of a portion of the work piece corresponding to the pressing surface of the punch and defining a scrap piece is not supported thereby allowing the scrap piece to automatically fall away from the remainder of the work piece after shearing.

12. The combination defined in claim 11, further comprising a coil spring, the coil spring subjecting the pad to a restoring force when the coil spring is contracted that provides a clamping force for clamping the work piece between the pad and the die.

13. The combination defined in claim 11, wherein the punch is arranged and constructed such that the portion of the work piece that is unsupported defines a pair of scrap pieces, each scrap piece located on an opposing outer side of the work piece.

* * * * *